US005221200A

United States Patent [19]

Roztocil et al.

[11] Patent Number: 5,221,200

[45] Date of Patent: Jun. 22, 1993

[54] RECEIVER MEMBER COOLING DEVICE

[75] Inventors: Tomas Roztocil, Caledonia; John J. Meyers, Penfield, both of N.Y.

[73] Assignee: Eastman Kodak Company, Rochester, N.Y.

[21] Appl. No.: 811,482

[22] Filed: Dec. 20, 1991

[51] Int. Cl.[5] ..... G03G 13/20

[52] U.S. Cl. ..... 432/59; 34/66; 34/92; 432/228

[58] Field of Search ..... 34/66, 92, 155; 432/228, 59

[56] References Cited

U.S. PATENT DOCUMENTS

| | | | |
|---|---|---|---|
| 3,402,762 | 9/1968 | Kreuter et al. | 34/66 |
| 3,515,855 | 6/1970 | Mix, Jr. | 432/59 |
| 3,598,486 | 8/1971 | Kushima | 355/10 |
| 3,861,863 | 1/1975 | Kudsi | 432/228 |
| 3,914,097 | 10/1975 | Wurl | 34/66 |
| 4,217,093 | 8/1980 | Steinlehner et al. | 432/59 |
| 4,525,057 | 6/1985 | Kaufmann et al. | 355/3 FU |
| 4,949,478 | 8/1990 | Socha | 34/155 |
| 4,959,693 | 9/1990 | Mitsuya et al. | 355/290 |

*Primary Examiner*—Henry C. Yuen

*Attorney, Agent, or Firm*—Lawrence P. Kessler

[57] ABSTRACT

In a reproduction machine wherein thermoplastic marking particles are permanently fixed to a receiver member by application of heat in a fusing assembly as the receiver member is transported along a travel path, an improved device for cooling the receiver member. The improved cooling device comprises a thermally conductive guide plate located in juxtaposition with the receiver member travel path downstream, in the direction of receiver member travel, of the fusing assembly. A plurality of heat transfer fins extend from the guide plate on the opposite side thereof from the travel path. The heat transfer fins are oriented in a direction parallel to the direction of travel of a receiver member along the travel path. Cooling air is directed over the heat transfer fins to dissipate heat from a receiver member moving along the travel path.

7 Claims, 2 Drawing Sheets

RECEIVER MEMBER COOLING DEVICE

BACKGROUND OF THE INVENTION

This invention relates in general to an apparatus for transporting receiver members in a reproduction machine, and more particularly to an improved cooling device associated with a transport apparatus for receiver members heated by a fuser assembly of a reproduction machine.

In typical reproduction machines, such as copiers or printers or the like, pigmented thermoplastic marking particles are placed on a receiver member (such as a cut sheet of plain paper or transparency material) in an image-wise pattern. The receiver member is transported along a path through a fuser assembly which permanently fixes the marking particle image to the receiver member by application of heat and pressure. With the marking particle image fixed to the receiver member, such member is then delivered to an output tray for operator retrieval.

While heat and pressure fusing has been found to be efficient for permanently fixing a marking particle image to a receiver member, the heat and pressure may have an adverse effect on the receiver member material. Particularly, the receiver member may warp or curl to an unacceptable extent. Additionally, if the heat absorbed by the receiver member material is not quickly dissipated, the receiver member may be too hot to be comfortably handled by the operator. Further, when a plurality of receiver members are stacked in an output tray, if sufficient cooling of the receiver members has not occurred, the respective marking particle images may still be tacky enough to cause adjacent receiver members to stick together.

In order to overcome the aforementioned heat and pressure induced receiver member handling problems in reproduction machines, the transport apparatus for the receiver members may include a cooling device for dissipating the heat from the receiver members. An example of such a cooling device is shown in U.S. Pat. No. 3,914,097 (issued Oct. 21, 1975, in the name of Wurl). In the cooling device of such patent, a housing located between the fuser assembly and the output has a flat guide plate in juxtaposition with the receiver member transport path. The guide plate has a plurality of heat transfer (cooling) fins on the opposite side of the plate from receiver member transport path. Such fins are oriented in a direction substantially transverse to the direction of movement of a receiver member along the receiver member transport path. The housing is in flow communication with a blower which provides a flow of cooling air over the heat transfer fins.

While the above described cooling device has generally been found to be effective in removing heat from the receiver members, and reducing their curl, it does have limitations as to the amount of heat it can dissipate for a given number and configuration of heat transfer fins and a selected blower size. With the more productive reproduction machines in common use today, or at extreme environmental conditions, the number and configuration of heat transfer fins or the size of the blower necessary to produce the desired cooling of receiver members may exceed physical size, electrical power, or acoustic noise constraints for a given reproduction machine.

SUMMARY OF THE INVENTION

This invention is accordingly directed to an improved cooling device for use in a reproduction machine wherein thermoplastic marking particles are permanently fixed to a receiver member by application of heat in a fusing assembly as the receiver member is transported along a travel path, the cooling device being of a configuration optimized so as to minimize the number and configuration of the heat transfer fins and the size of the blower necessary to provide desired receiver member cooling. The improved cooling device comprises a thermally conductive guide plate located in juxtaposition with the receiver member travel path downstream, in the direction of receiver member travel, of the fusing assembly. A plurality of heat transfer fins extend from the guide plate on the opposite side thereof from the travel path. The heat transfer fins are oriented in a direction parallel to the direction of travel of a receiver member along the travel path. Cooling air is directed over the heat transfer fins to dissipate heat from a receiver member moving along the travel path. In a further aspect of the improved receiver member cooling device according to this invention, the flow of cooling air is established in a direction parallel to the heat transfer fins and opposite to the direction of transport of a receiver member along the travel path.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
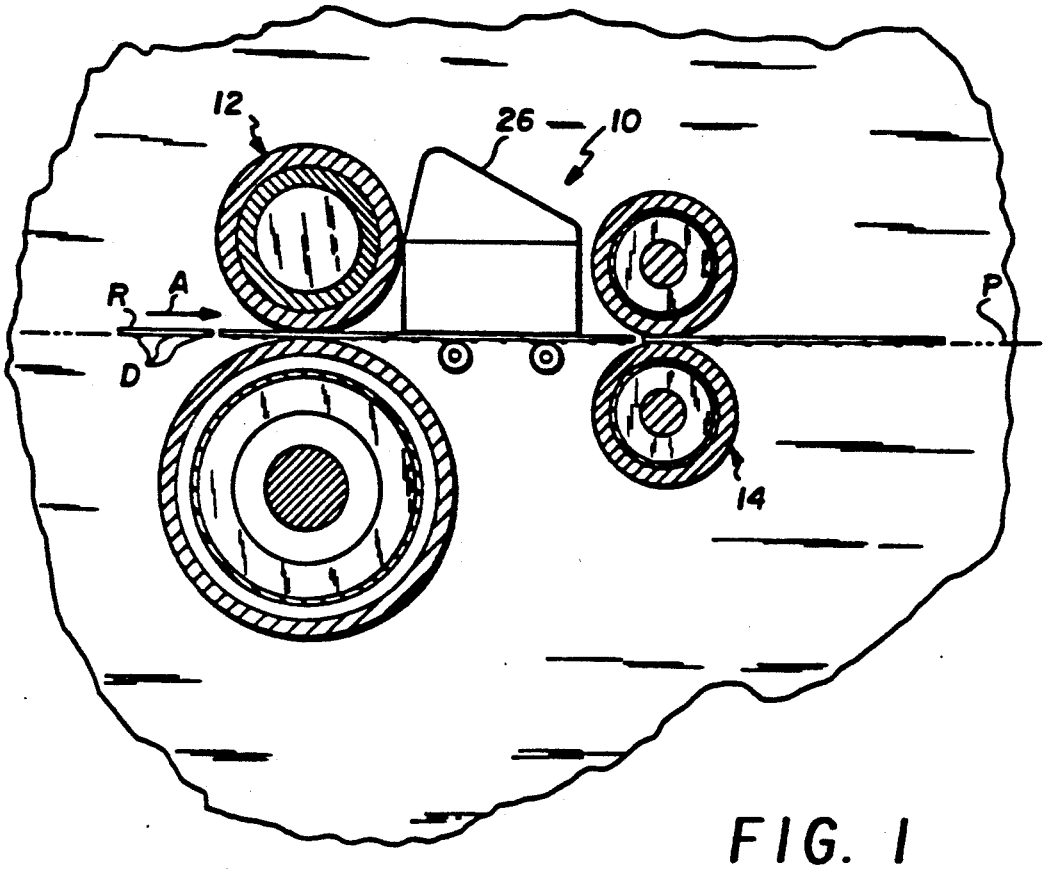
FIG. 1 is a side elevational view, partly in cross-section, of a receiver member transport path in a reproduction machine incorporating the improved receiver member cooling device according to this invention.

As discussed above, in typical well known reproduction machines, such as copiers or printers or the like, pigmented thermoplastic marking particles are placed on a receiver member in an image-wise pattern and permanently fixed to the receiver member by the application of heat. The heat absorbed by the receiver member material must be efficiently dissipated rapidly to prevent curling of the receiver member, or prevent multiple stacked receiver members from sticking to one another. Referring now to the accompanying drawings, FIG. 1 shows the improved receiver member cooling device according to this invention, designated generally by the numeral 10, as incorporated in a reproduction machine of this general type.

The improved receiver member cooling device 10 is located in association with a portion of a reproduction machine travel path P along which receiver members R are transported, in any well known manner, in the direction of arrow A. The receiver members, bearing marking particles in an image-wise pattern, pass through the fuser assembly 12 where heat (and pressure) cause the marking particles to become permanently fixed to the respective receiver members. Thereafter, each of the receiver members are transported by the roller pair 14 toward a downstream location such as an output tray (not shown) for operator retrieval. The improved cooling device 10, positioned between the fuser assembly 12 and the roller pair 14, serves to provide the desired heat dissipation from the receiver members.

In order to optimize the efficiency of the improved receiver member cooling device 10 according to this invention, the cooling device is constructed in the manner best shown in FIGS. 2–4 and fully described hereinbelow. The cooling device 10 includes a thermally conductive guide plate 20 located in juxtaposition with the travel path P for the receiver members. A plurality of heat transfer fins 22 extend from the guide plate 20, on the opposite side thereof from the travel path P. The heat transfer fins 22 are oriented in a direction parallel to the receiver member travel path P. A blower 24 (see FIG. 4), of the vacuum type in the illustrated embodiment, is provided to create a flow of cooling air over the heat transfer fins. Since the direction of flow for the cooling air through the improved cooling device 10 is essential to provide the desired optimum heat transfer (dissipation) efficiency, a housing 26 of the particular shown configuration is constructed for the cooling device.

The housing 26 of the improved receiver member cooling device 10 according to this invention includes side walls 28*a*, 28*b* outboard of the heat transfer fins 22, and a front wall 30 upstream of the heat transfer fins. Such walls are respectively attached to the guide plate 20 to enclose the heat transfer fins 22 on three sides (leaving an open side at the downstream edges of the heat transfer fins, as best shown in FIG. 3). A plenum chamber 32 is supported on the side and front walls and overlies the heat transfer fins 22. One wall of the plenum chamber 32 has an opening 32*a* (see FIG. 2) defined therethrough. The blower 24 is connected by suitable ducting 24*a* to the opening 32*a* to provide the blower with flow communication to the interior of the plenum chamber. Finally, a baffle plate 34 is located between the interior of the plenum chamber and the heat transfer fins 22. The baffle plate extends from the respective downstream edges of the heat transfer fins 22 toward the respective upstream edges of the heat transfer fins. However, the baffle plate terminates at an edge 34*a* spaced from such upstream edges. The edge 34*a* lies at an angle to the front wall 30 (best shown in FIG. 3), being closest to the front wall at the side of the plenum chamber to which the blower 24 is connected and farthest from the front wall at the side of the plenum chamber remote from the blower connection side.

Figure 2:
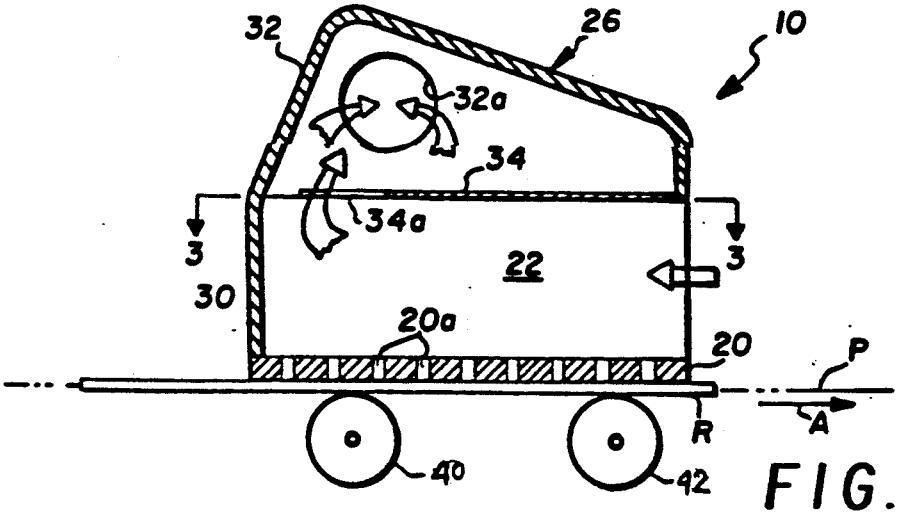
FIG. 2 is a side elevational view, in cross-section and on an enlarged scale, of the improved receiver member cooling device according to this invention.
Figure 3:
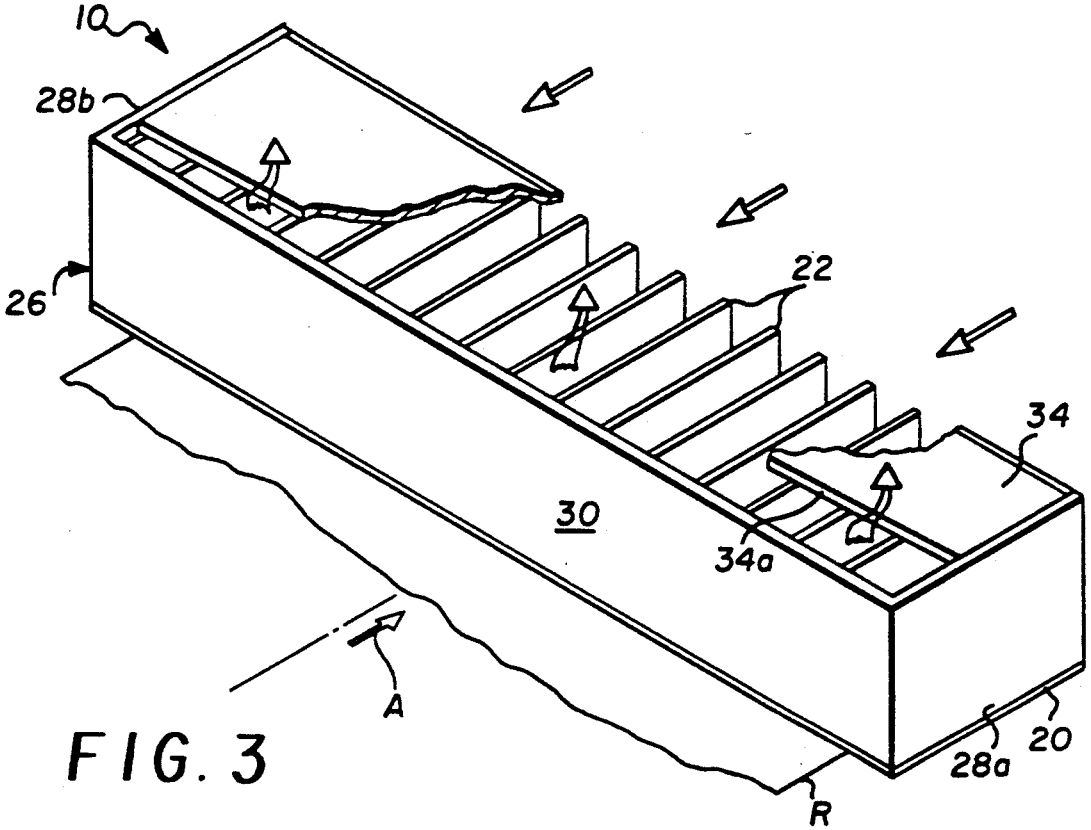
FIG. 3 is view, in perspective, of the improved receiver member cooling device according to this invention, taken along the lines 3—3 of FIG. 2, with portions broken away or removed to facilitate viewing.
Figure 4:
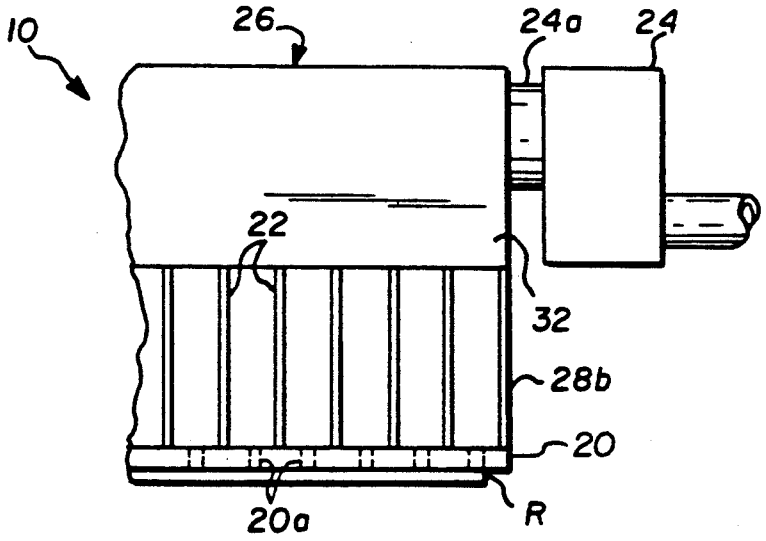
FIG. 4 is a rear elevational view of a portion of the improved receiver member cooling device according to this invention.

With the housing 26 of the improved cooling device 10 according to this invention being constructed as described, when the blower 24 is activated, cooling air is drawn through the open side of the housing (the cooling air flow is designated in the FIGS. 2 and 3 by large arrows). The cooling air flows across the heat transfer fins 22 in a flow direction parallel to the heat transfer fins and, in the preferred embodiment, opposite to the direction of receiver member transport along the travel path P, then up through the interior of the plenum chamber 32 to the blower. The baffle plate 34 forces the cooling air to flow more uniformly from side-to-side of the housing 26. That is, since the opening between the interior of the plenum chamber 32 and the heat transfer fins 22 is narrower at the side closer to the blower and wider at the side furthest from the blower, the pressure drop (and flow differential) from side-to-side is substantially compensated for.

In operation, a receiver member R bearing a marking particles D (in an image-wise pattern) fixed thereto by the fusing assembly 12 is transported along the travel path P. Downstream of the fuser assembly, the receiver member is transported in sliding contact with the thermally conductive guide plate 20 of the cooling device 10 by rollers 40 and 42 in substantial nip relation with the guide plate. The roller 42 may be rotated at an angular velocity slightly greater than that of roller 40 so that the receiver member is urged to remain flat against the guide plate 20. Additionally, the thermally conductive guide plate 20 has a plurality of ports defined therethrough. The receiver member R is held in intimate contact with the guide plate as it slides therealong by vacuum forces induced by the cooling air flow through the cooling device 10 and effective through the ports 20*a*. While in such intimate contact, the heat from the receiver member is efficiently transferred to the thermally conductive guide plate 20 and then to the heat transfer fins 22. Heat from the the receiver member is thus efficiently dissipated rapidly. Further, because the receiver member is held flat against the thermally conductive guide plate 20 as it is cooled, warping is substantially prevented.

By the described configuration, there are more shorter heat transfer fins provided then found in prior receiver member cooling devices. As such, pressure drop across the cooling device (from the downstream edge to the upstream edge) is reduced because of the shorter fins, yet more rib surface area is provided within the equivalent physical space. This substantially increases heat transfer efficiency without impacting air flow. Further, since the cooling air to heat transfer rib differential temperature is far greater with the shorter fins, and since the fins are parallel to the receiver member travel path, a more uniform cooling (side-to-side) is achieved.

The invention has been described in detail with particular reference to preferred embodiments thereof, but it will be understood that variations and modifications can be effected within the spirit and scope of the invention.

We claim:

1. In a reproduction machine wherein thermoplastic marking particles are permanently fixed to a receiver member by application of heat in a fusing assembly as said receiver member is transported along a travel path, an improved device for cooling said receiver member, said improved receiver member cooling device comprising:

a thermally conductive guide plate located in juxtaposition with said travel path downstream, in the direction of receiver member travel, of said fusing assembly;

a plurality of heat transfer fins extending from said guide plate on the opposite side thereof from said travel path, said heat transfer fins being oriented in a direction parallel to the direction of travel of a receiver member along said travel path; and means for directing a flow of cooling air over said heat transfer fins, said flow directing means including a baffle associated with said heat transfer fins so as to provide for substantially uniform cooling air flow over said heat transfer fins in a direction parallel to said heat transfer fins.

2. The improved receiver member cooling device of claim 1 wherein said air flow directing means further includes a blower, said blower being effective on operation for establishing said air flow in a direction opposite to the direction of travel of a receiver member.

3. The improved receiver member cooling device of claim 1 wherein said air flow directing means includes a housing attached to said guide plate substantially enclosing said heat transfer fins, said housing defining an opening adjacent to one end of said heat transfer fins, and a blower associated with said housing and effective on operation to draw cooling air through said opening and over said heat transfer fins.

4. The improved receiver member cooling device of claim 3 wherein said blower is attached to said housing at one end transverse to said travel path, and said baffle is formed as a portion of said housing and is spaced from a wall of said housing at an angle thereto, said internal baffle edge being closest to said front wall at the side of said plenum chamber to which said blower is connected and farthest from said front wall at the side of the plenum chamber remote from said blower connection side.

5. The improved receiver member cooling device of claim 1 wherein said thermally conductive guide plate defines a plurality of ports extending therethrough, such that when said air flow directing means directs cooling air over said heat transfer fins, vacuum forces are induced thereby effective through said ports to hold a receiver member in intimate contact with said thermally conductive guide plate.

6. In a reproduction machine wherein thermoplastic marking particles are permanently fixed to a receiver member by application of heat in a fusing assembly as said receiver member is transported along a travel path, an improved device for cooling said receiver member, said improved receiver member cooling device comprising:

a thermally conductive guide plate located in juxtaposition with said travel path downstream, in the direction of receiver member travel, of said fusing assembly;

a plurality of heat transfer fins extending from said guide plate on the opposite side thereof from said travel path, said heat transfer fins being oriented in a direction parallel to the direction of travel of a receiver member along said travel path;

a housing attached to said guide plate substantially enclosing said heat transfer fins with an opening adjacent to the downstream edges of said heat transfer fins, said housing including a front wall located adjacent to the upstream edges of said heat transfer fins, a pair of side walls connected to said front wall outboard of said heat transfer fins, a plenum chamber connected to said front and side walls and overlying said heat transfer fins, and an internal baffle associated with said heat transfer fins and said plenum chamber, said internal baffle having an edge located in spaced relation with said front wall of said housing at an angle thereto so as to provide a path for substantially uniform cooling air flow over said heat transfer fins in a direction opposite the direction of travel of a receiver member along said travel path; and a blower connected in flow communication with said plenum chamber adjacent to one side wall of said housing where said internal baffle edge is closest to said front wall, operation of said blower serving to draw cooling air through said opening of said housing and over said heat transfer fins.

7. The improved receiver member cooling device of claim 6 wherein said thermally conductive guide plate defines a plurality of ports extending therethrough, such that when said air flow directing means directs cooling air over said heat transfer fins, vacuum forces are induced thereby effective through said ports to hold a receiver member in intimate contact with said thermally conductive guide plate.

* * * * *